US005514007A

United States Patent [19]

Rodrigues

[11] Patent Number: 5,514,007

[45] Date of Patent: May 7, 1996

[54] DATA CONNECTOR STRAIN RELIEF ASSEMBLY

[75] Inventor: Julio F. Rodrigues, Collierville, Tenn.

[73] Assignee: Thomas & Betts Corporation, Memphis, Tenn.

[21] Appl. No.: 237,694

[22] Filed: May 4, 1994

[51] Int. Cl.[6] ..... H01R 13/58

[52] U.S. Cl. ..... 439/469; 439/449

[58] Field of Search ..... 439/449, 460, 439/469, 470, 472, 452, 454, 461, 462

[56] References Cited

U.S. PATENT DOCUMENTS

| | | | |
|---|---|---|---|
| 2,091,054 | 8/1937 | Petrie | 439/472 X |
| 3,689,014 | 9/1972 | Fink | 439/449 X |
| 4,033,535 | 7/1977 | Moran | 439/449 X |
| 4,056,252 | 11/1977 | Simon | 248/56 |
| 4,108,527 | 8/1978 | Douty et al. . | |
| 4,209,661 | 6/1980 | Pate et al. | 174/65 |
| 4,223,178 | 9/1980 | Lass | 174/65 |
| 4,229,616 | 10/1980 | Hotchkiss | 439/469 X |
| 4,367,005 | 1/1983 | Douty et al. . | |
| 4,416,503 | 11/1983 | Hayes | 439/469 OR |
| 4,449,778 | 5/1984 | Lane . | |
| 4,501,459 | 2/1985 | Chandler et al. . | |
| 4,508,415 | 4/1985 | Bunnell . | |
| 4,561,715 | 12/1985 | Sanchez . | |
| 4,602,833 | 7/1986 | Grabbe et al. . | |
| 4,619,494 | 10/1986 | Noorily et al. . | |
| 4,636,023 | 1/1987 | Olsson . | |
| 4,641,906 | 2/1987 | Olsson . | |
| 4,702,542 | 10/1987 | Noyes | 439/347 |
| 4,722,580 | 2/1988 | Kocher et al. | 439/466 |
| 4,744,769 | 5/1988 | Grabbe et al. | 439/284 |
| 4,749,369 | 6/1988 | Wang | 439/459 |
| 4,822,286 | 4/1989 | Bianca | 439/610 |
| 4,891,022 | 1/1990 | Chandler et al. | 439/610 |
| 4,917,628 | 4/1990 | Bogese, II | 439/391 |
| 4,921,441 | 5/1990 | Sauder | 439/460 |
| 5,052,940 | 10/1991 | Bengal | 439/188 |
| 5,104,337 | 4/1992 | Chow et al. | 439/470 |
| 5,195,909 | 3/1993 | Huss, Jr. et al. | 439/465 |
| 5,199,891 | 4/1993 | Reed | 439/98 |

FOREIGN PATENT DOCUMENTS

| | | |
|---|---|---|
| 2406003 | 8/1974 | Germany . |
| 2183405 | 6/1987 | United Kingdom . |

*Primary Examiner*—Larry I. Schwartz
*Assistant Examiner*—Daniel Wittels
*Attorney, Agent, or Firm*—Salvatore J. Abbruzzese

[57] ABSTRACT

An electrical data connector includes cable strain relief for accommodating a cable of at least two differing diameters. A cable strain relief assembly frictionally secures either of the cables therein. The strain relief assembly includes a strain relief body including first and second cable channels for permitting accommodation alternatively of one of the at least two cables. A channel filler block is insertable into the first channel to render the first channel cable inaccessible and render exclusively the second channel accessible to cable passage. A strain relief plug works in cooperation with said strain relief body to secure the cable supported either in the first or second channel in strain relief fashion.

22 Claims, 4 Drawing Sheets

DATA CONNECTOR STRAIN RELIEF ASSEMBLY

FIELD OF THE INVENTION

The present invention relates generally to electrical data connectors. More particularly the present invention relates to an improved strain relief assembly for securing a jacketed multi-conductor cable terminated by an electrical data connector.

BACKGROUND OF THE INVENTION

Electrical data connectors are commonly employed to terminate signal carrying jacketed multi-conductor electrical cables which are used to connect various components of a data/communication system. Examples of electrical data connectors are shown in U.S. Pat. Nos. 4,449,788, 4,501,459 and 4,619,494. Each of these data connectors includes a connector housing which supports a plurality of insulation displacement type electrical contacts. The individual conductors of the multi-conductor cable are terminated by the contacts for electrical connection therewith. The jacketed cable extends externally of the connector housing for extension to another component of the system. As interconnection is dependent upon a good termination of the conductors of the cable with the contacts, it is necessary to assure that any strain placed on the jacketed cable is not transmitted to the contact termination. Such strain could cause dislodgement of one or more of the conductors from the contacts. This would result in failure of the connector and accordingly the inoperability of the component to which it is terminated.

The electrical connector art and specifically the data connector art, has seen a wide variety of strain relief devices employed both internally and externally of the connector having to provide strain relief to the cable extending therefrom. Each of the above-identified patents shows a technique for providing cable strain relief. While each of the various cable strain relief devices shown, attempt to adequately support the jacketed cable in the connector, it has been found that these prior art devices may include many parts and therefore may be difficult to assemble. Also, such devices do not adequately accommodate a range of cable sizes in a single strain relief device. Further, these prior art devices may not protect against both inward and outward movement of the cable in the connector, as well as potential rotation of the cable in the connector.

It is therefore desirable to provide an improved strain relief device for use with a data connector which is easy to assemble, provides superior strain relief and which accommodates a range of cable sizes.

SUMMARY OF THE INVENTION

It is an object of the present invention to provide an electrical data connector for terminating jacketed multi-conductor electrical cable.

It is further object of the present invention to provide an improved strain relief for securing the jacketed multi-conductor cable in the connector housing.

It is a still further object of the present invention to provide an electrical connector strain relief device which will accommodate a range of cable sizes and which will prevent cable movement both into and out of the connector as well as prevent rotation of the cable in the connector.

In the efficient attainment of these and other objects the present invention provides an electrical connector for terminating jacketed multi-conductor cables of at least two differing cable jacket diameters. The connector includes a connector housing for accommodating an end extent of either said cable. The connector includes a cable passage port therethrough permitting ingress and egress of the cables. The cable strain relief assembly frictionally engages and secures either of the cable. The strain relief assembly includes a strain relief body which is removably positionable in the connector housing adjacent the cable passage port. The strain relief body defines first and second cable channels, each channel accessible alternatively for accommodating exclusively one of the cables. The strain relief assembly further includes a channel filler block insertable into the first channel to fill the first channel preventing cable accommodation therein and rendering the second channel accessible for cable accommodation. The strain relief assembly additionally includes a strain relief plug insertably accommodated in the strain relief body. The plug is positioned to engage either of the cables positioned in either the first channel or second channel whereby either cable is supported in strain relief fashion between the strain relief body and the strain relief plug.

As more particularly described by way of the preferred embodiment herein the strain relief body includes a generally U-shaped member defining both the first and second cable channels. The first channel is defined by a recess in the bottom wall of the U-shaped member and the channel filler block is insertable into the recess in the bottom wall of the U-shaped member to close off the first channel rendering accessible only the second channel.

In a further aspect of the present invention, the connector housing includes plural cable passage ports permitting cable passage at plural different locations with respect to the connector housing. The strain relief body is removably positionable in the connector housing and includes a cable accommodating channel positionable adjacent one of the plural cable passage ports. The strain relief body further includes port closing portions positionable adjacent the other ones of said plural cable passage ports for excluding cable passage therethrough.

DETAILED DESCRIPTION OF THE PREFERRED EMBODIMENT

Figure 1:
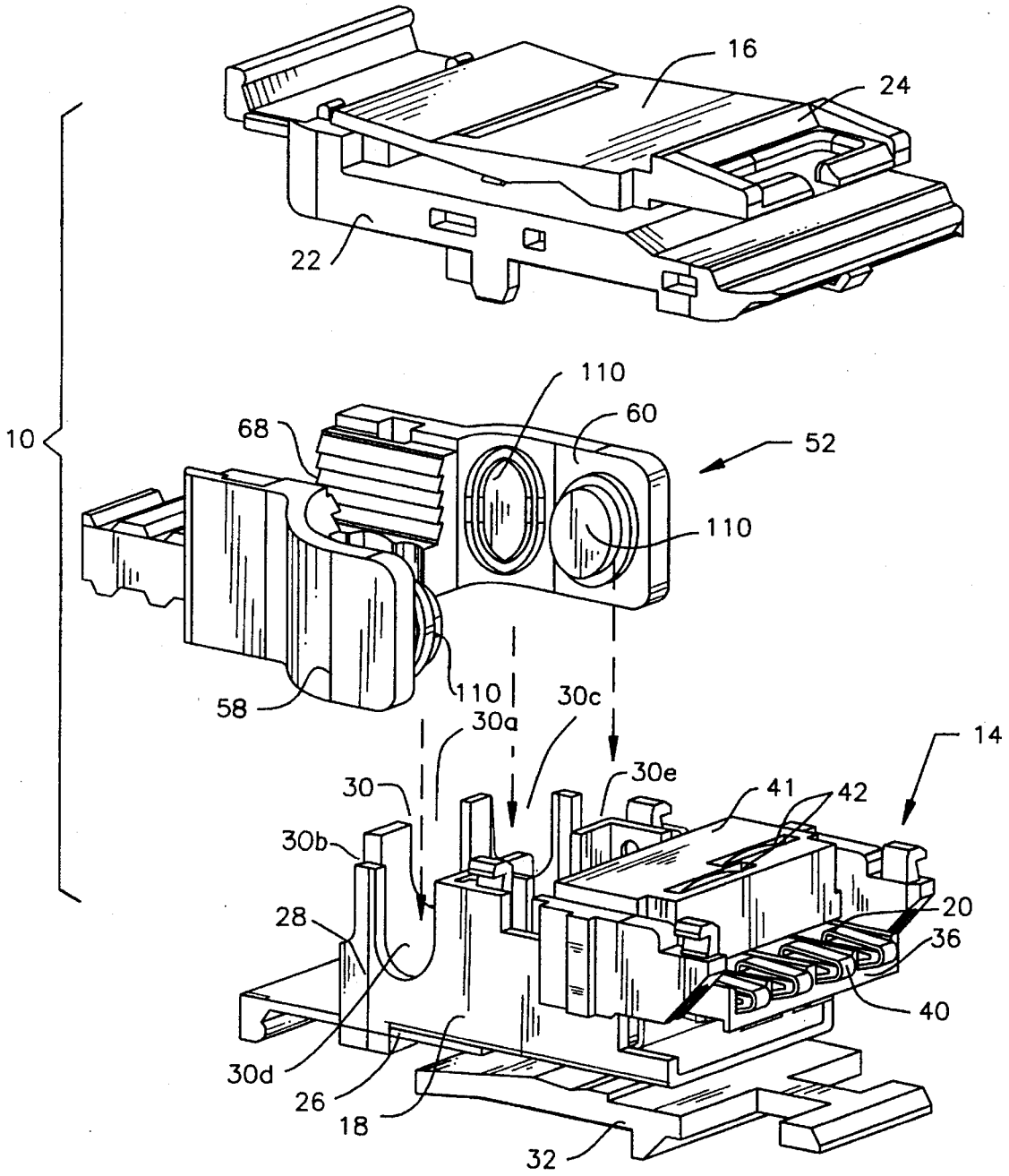
FIG. 1 shows in exploded perspective view, the data connector including a portion of the strain relief assembly of the present invention.
Figure 6:
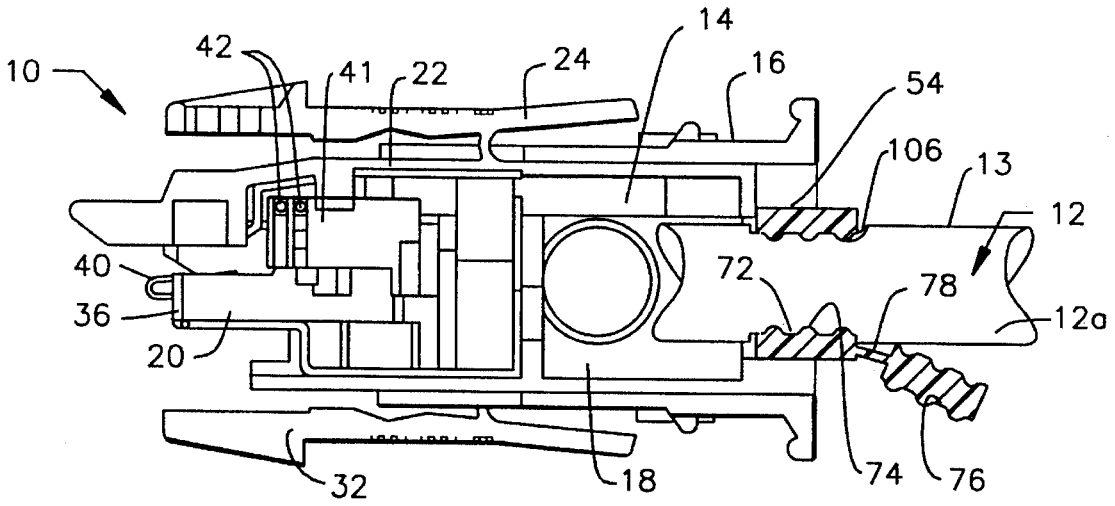
FIGS. 6 and 7 are side elevational showings, partially in section, of the electrical connector and strain relief assembly of the present invention terminating cables having two differing cable diameters respectively.
Figure 7:
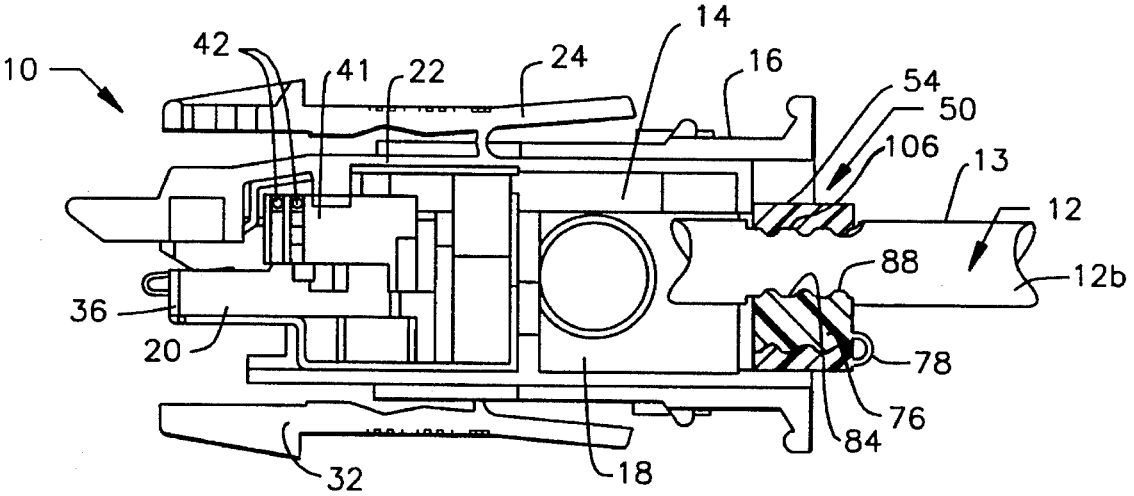

Referring to FIGS. 1, 6 and 7, a shielded electrical data connector 10 of the present invention is shown. Data connector 10 is of the type used to terminate a multi-conductor jacketed data cable 12. Connector 10 is substantially similar to the connector shown in U.S. Pat. No. 4,619,494 issued Oct. 28, 1986 entitled "Shielded Electrical Connector", which is assigned to the Assignee of the present invention and which is incorporated by reference herein for all purposes.

Connector 10 comprises a generally elongate rectangular insulative housing 14 defined by a cover 16 and a base 18. Connector 10 supports between cover 16 and base 18 a termination subassembly 20. Housing 14 may include an electrical shield (not shown) which provides for effective shielding of connector 10 from electro-magnetic interference and radio frequency interference which is prevalent in the environment in which connector 10 is used. Cover 16 includes a generally elongate planar lid 22 which supports a latching mechanism 24. Base 18 includes a bottom base wall 26 and an upstanding side wall 28 which partially surrounds base wall 26. Side wall 28 includes a plurality of generally U-shaped cable entry ports 30 which provide for passage of cable 12 into housing 14. In the present illustrative embodiment, five cable entry ports 30 are positioned such that cable 12 may extend out of housing 14 directly rearwardly through port 30*a* or offset to either side at a 45° angle through ports 30*b* and 30*c* or at a 90° angle through ports 30*d* and 30*e*.

Base wall 26 further includes an additional latching mechanism 32 which in combination with latching mechanism 24 of cover 16 permits interconnection of connector 10 with another similarly constructed connector in a manner described in greater detail in the above-identified '494 patent.

Termination subassembly 20, which is housed between cover 16 and base 18, includes an insulative contact holder 36 which support a plurality of insulation displacing electrical contacts 40 which individually terminate the conductors of multi-conductor cable 12. Termination subassembly also includes a conductor support block 41 for supporting the conductors of the multi-conductor cable 12 for termination with contacts 40. The conductor support block 41 may also support shunt bars 42 for shunting one contact 40 to another. The electrical termination of cable 12 within data connector 10 is more fully described in the above-identified '494 patent.

Figure 2:
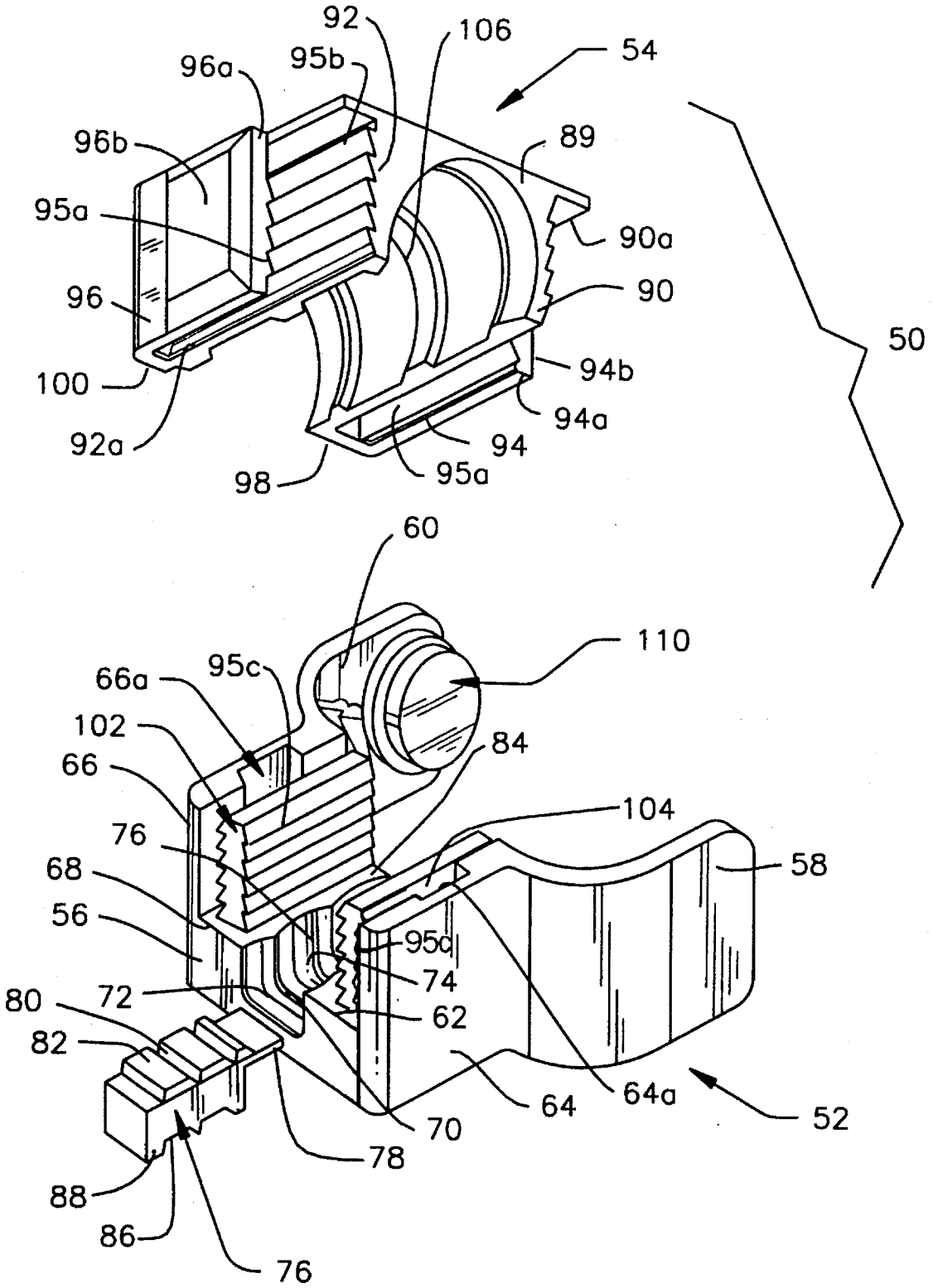
FIG. 2 shows in exploded perspective view, the strain relief assembly of FIG. 1 removed from the connector.

The present invention is directed primarily to an improved strain relief assembly 50 shown removed from data connector 10 in FIG. 2. Strain relief assembly 50 includes a strain relief body 52 and a strain relief plug 54 which is insertably accommodated by strain relief body 52 to secure cable 12 therebetween as will be described in further detail hereinbelow. Strain relief body 52 includes a central body portion 56 which is generally a U-shaped member and includes a pair of curved frontwardly directed arms 58 and 60 extending therefrom. Central body portion 56 includes a bottom wall 62 and a pair of spaced apart side walls 64 and 66 which extend upwardly from bottom wall 62. Arms 58 and 60 extend outwardly respectively from side walls 64 and 66. Bottom wall 62 and side walls 64 and 66 define generally an open ended cable passage 68 which together with strain relief plug 54 define a fully enclosed bounded region for accommodating cable 12.

With reference now to FIGS. 2, 6 and 7, it can be seen that the strain relief assembly 50 of the present invention is designed to accommodate cables of at least two differing diameters. For ease of description, the multiconductor cable will generally be denoted by reference numeral 12. The larger diameter cable will be denoted by reference numeral 12*a*, while the smaller diameter cable will be denoted by reference numeral 12*b*. The cable jacket will be denoted by reference numeral 13.

Central body portion 56 defining cable passage 68 includes a recess 70 centrally positioned and extending partially through bottom wall 62. Recess 70 defines a first cable channel 72 which permits accommodation of the cable 12*a* of a relatively large diameter cable, such as shown in FIG. 6. A bottom surface 76 of recess 70 includes a plurality of spaced apart transversely extending raised ridges 74 which are engagable with cable 12*a* for frictional securement of the jacket 13 therein.

In order to accommodate in strain relief fashion, a cable 12*b* having a smaller diameter, such as that shown in FIG. 7, the present invention provides a filler block 76 which is attached to central body portion 56. Filler block 76 is generally a rectangular member having a first planar surface 82 and an opposed second planar surface 86. Filler block 76 is integrally formed with strain relief body 52 and is tethered thereto by a flexible hinge 78. Filler block 76 is sized to fit within and fill recess 70. In order to use filler block 76 the filler block is folded about hinge 78 and is inserted into recess 70. A plurality of transverse channels 80 on first planar surface 82 of filler block 76 are engagable with raised ridges 74 in recess 70 to provide proper positioning of filler block 76 in recess 70. With filler block 76 inserted in recess 70, central body portion 56 of strain relief body 52 defines a second channel 84 raised above first channel 72 which is partially defined by a second planar surface 86 of filler block 76. Second planar surface 86 also includes a plurality of raised ridges 88 which, as shown in FIG. 7, are positioned for frictional engagement with jacket 13 of smaller diameter cable 12*b*.

The strain relief assembly 50 of the present invention permits accommodation of cables 12 having at least two differing cable diameters by providing a first channel 72 for cables of larger diameter and a second channel 84 for cables of smaller diameter. When employing first channel 72 for cable 12*a* of larger diameter, filler block 76 may be removed from strain relief body 52. Hinge 78 is designed to be frangible to permit such easy removal.

In order to securely frictionally retain either cable 12*a* or 12*b* within cable passage 68, strain relief plug 54 is movably supported over strain relief body 52. Strain relief plug 54 is generally a U-shaped member having a top wall 88, a pair of depending side walls 90 and 92. Strain relief plug 54 includes a pair of longitudinally extending latch walls 94 and 96 which are spaced from and extend along side walls 90 and 92 respectively. A pair of transverse back walls 98 and 100 support respectively latch walls 94 an 96 for extension in a cantilevered manner therefrom. The interior surfaces 94*a* and 96*a* of latch walls 94 and 96 respectively, include tooth-like serrations 95*a* therealong. Further, the exterior surfaces 90*a* and 92*a* of side walls 90 and 92 respectively which face the interior surfaces 94*a* and 96*a* also include similar tooth-like serrations 95*b*. These serrations 95*a* and 95*b* permit movable locking engagement of strain relief plug 54 with strain relief body 52 as will be now more fully described.

Strain relief body 52 includes a pair of interiorly positioned locking walls 102 and 104 which extend upwardly from bottom wall 62. Walls 102 and 104 are spaced inwardly from side walls 64 and 66 respectively. The spacing between the respective side walls 64 and 66 and locking walls 102 and 104 permit accommodation of latch walls 94 and 96 therebetween. Opposed surfaces of locking walls 102 and 104 include tooth-like serrations 95*c* similar to the serrations 95*a* and 95*b* of strain relief plug 54. In order to properly position and guide strain relief plug 54 into strain relief body 52, the internal surface of each of side walls 64 and 66 includes guide tracks 64*a* and 66*a* respectively. These guide tracks are dimensioned to accommodate outwardly extending ribs 94*b* and 96*b* on the external surface of latch walls 94 and 96 respectively. Strain relief plug 54 is designed to be movably accommodated within strain relief body 52. Ribs 94*b* and 96*b* are insertable into guide tracks 64*a* and 66*a* with teeth-like serrations 95*c* of locking walls 102 and 104 interengaging, in a tooth-like fashion, the serrations 95*a* and 95*b* of side walls 90 and 92 and latch walls 94 and 96 so as to securely movably position strain relief plug 54 with respect to strain relief body 52.

As shown with respect to FIGS. 6 and 7, strain relief plug 54 may be moved with respect to strain relief body 52 until strain relief plug 54 engages in a frictional manner, jacket 13 of either cable 12*a* or 12*b* supported therebetween. The interior U-shaped surface of strain relief plug 54 may include a plurality of transversely extending ridges 106 similar to ridges 74 for frictionally securing the cable jacket. Strain relief plug 54 is designed to be inserted into strain relief body 52 until it bottoms out in strain relief body 52. This will occur regardless of the diameter of the cable secured therebetween. Thus, there is no tendency to over or under insert strain relief plug 54 in strain relief body 52.

As shown particularly in FIGS. 6 and 7, as the larger diameter cable 12*a* is supported in first channel 72 (FIG. 6) and as the smaller diameter cable 12*b* (FIG. 7) is supported in second channel 84 which is raised from first channel 72 by use of filler block 76, the strain relief plug 54 may be inserted to the same position with respect to strain relief body 52 and still frictionally secure each of the cables therebetween. The frictional securement of cables 12*a* and 12*b* between strain relief plug 54 and strain relief body 52 prevents both insertion and withdrawal thereof with respect to data connector 10 as well as rotational movement therein.

A further feature of the strain relief assembly 50 of the present invention is shown in FIGS. 1 and 2. As above described, side wall 28 of base 18 of data connector 10 includes a plurality of generally U-shaped cable entry ports 30 which permit accommodation of cable 12 at multiple positions. However in use, only one cable entry port 30 is employed with any given data connector configuration. Thus it is necessary to close off the unused ports of housing 14. Strain relief assembly 50 of the present invention provides integrally therewith means for closing off the unused cable entry ports 30.

In the present illustrative embodiment of FIGS. 1 and 2, port 30*a* extending directly rearwardly from data connector 10 is employed for cable entry, thus cable passage 68 of strain relief body 52 is aligned with that cable entry port 30*a*. Arms 58 and 60 of strain relief body 52 provide for the closure of the remaining cable entry ports 30*b–e*. Arms 58 and 60 extend generally along curved side wall 28 of base 18 to overlie the remaining cable entry ports 30*b–e* when strain relief body is positioned within housing 14. In order to help guide strain relief body 52 with respect to side walls 28 and to fully close off unused ports 30*b–e*, arms 58 and 60 include a plurality of inwardly directed protrusions 110 which fit within the U-shaped cable entry ports 30. As shown in the drawings, protrusions 110 are generally oval in shape, however other suitable shapes may be employed. Protrusions 110 securely fit within U-shaped ports 30 and help secure strain relief body 52 in housing 14. Thus arms 58 and 60 together with protrusions 110 close off all unused cable entry ports 30 providing cable access only through a single port which supports cable passage 68 of strain relief body 52. In the embodiment shown in FIGS. 1 and 2, the cable entry port 30*a* is positioned directly rearwardly of data connector 10. This may be referred to a "straight through" or 180° cable exit. However, any of the other cable entry ports 30*b–e* may also be employed. The present invention contemplates modifications to strain relief body 54 to accommodate other directions of cable entry.

Figure 3:
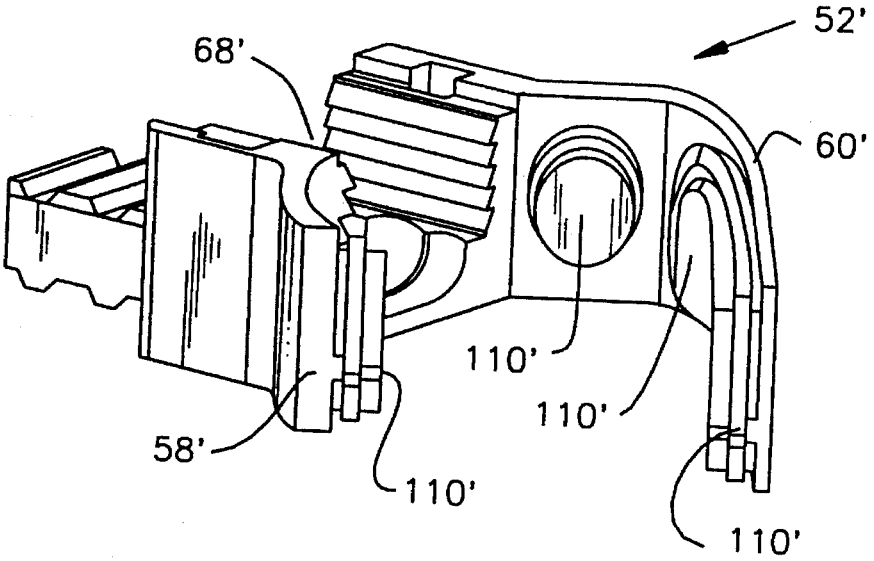
FIG. 3 is a perspective showing of a further embodiment of a strain relief body of the strain relief assembly of the present invention.
Figure 4:
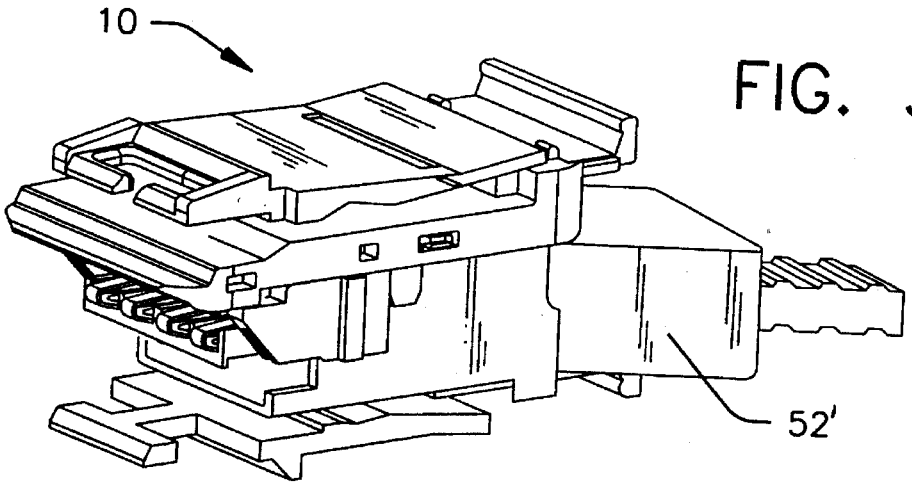
FIGS. 4 and 5 are perspective showings of the data connector of FIG. 1 including the further embodiment of the strain relief body of FIG. 3.
Figure 5:
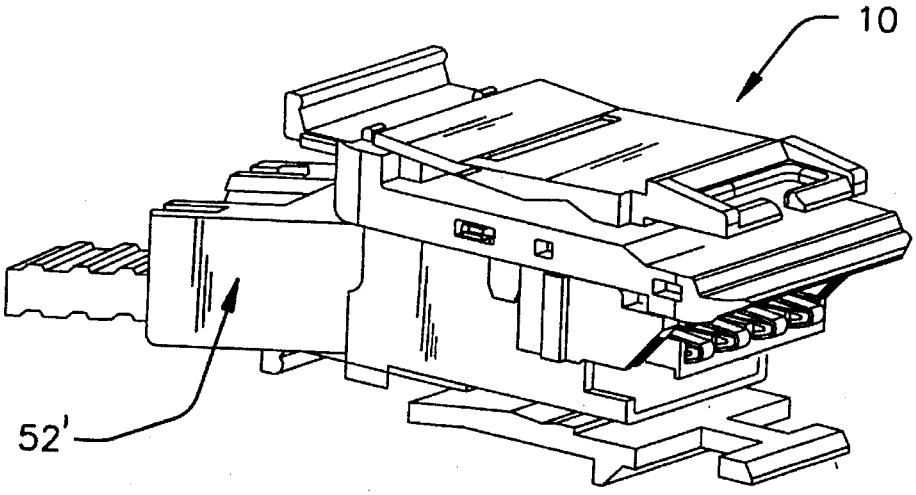

Shown in FIGS. 3, 4 and 5 are modifications to strain relief body 52 which permit cable exit at ports 30*b* and 30*c* to either side of the port 30*a* (FIG. 1). These ports are known as 45° cable exit/entry ports. FIGS. 4 and 5 show two possible 45° cable exit/entry orientations which may be provided by the single embodiment shown in FIG. 3. With additional reference to FIG. 1, strain relief body 52' includes a cable passage 68' which is positioned to be adjacent one of the cable ports 30*b* or 30*c* to either side of the cable port 30*a* extending directly rearwardly of data connector 10. As will be described in further detail hereinbelow, strain relief body 52' may be used to access either port 30*b* or 30*c* on either side of rearwardly extending port 30*a*. As cable passage 68' accesses one of the side ports 30*b* or 30*c*, arm 60' extending from central body portion 56' is elongated while arm 58' is truncated so that the arms conform to upstanding side wall 28 of base 18 in order to close off the cable entry ports 30 not cable accessible. As above described, arms 58' and 60' include inwardly directed projections 110' which fit within the unused ports 30 to completely seal off these ports preventing access thereto. In all other respects, strain relief body 52' functions identically to strain relief body 52 of the previously described embodiment. In fact, strain relief plug 54 (FIG. 2) may be used with either embodiment shown herein.

Strain relief body 52 may be used to access either 45° cable entry port 30*b* or 30*c* by employing strain relief body 52' in one orientation or by inverting strain relief body 52' to access the other 45° port. Such dual orientations are shown in FIGS. 4 and 5. Thus strain relief body 52' may be employed to access two differing cable entry ports 30*b* and 30*c*.

While not shown herein, it is contemplated that a further strain relief body may be constructed to access the remaining two ports 30*d* and 30*e* which extend at 90° from data connector 10. Such strain relief body would also include structure to close off the unused ports.

Referring again to FIG. 1, once strain relief body 52 or 52' is inserted within housing 14, cable 12 may be terminated within housing 14 (FIGS. 6 and 7). Cable 12 is positioned to extend out of the appropriate port with strain relief being provided by strain relief assembly 50. Cover 16 may then be snapped onto base 18 to assemble data connector 10 which is now usable for interconnection purposes.

Various changes to the foregoing described and shown structures would now be evident to those skilled in the art. Accordingly, the particularly disclosed scope of the invention is set forth in the following claims.

What is claimed is:

1. An electrical connector for terminating a jacketed multi-conductor cable of at least two differing cable diameters, said connector comprising:

a connector housing for accommodating an end extent of said cable, said connector including a cable passage port therethrough; and a cable strain relief assembly for frictionally engaging and securing said cable, said cable strain relief including:

a strain relief body insertably positionable in said connector housing adjacent said cable port, said strain relief body defining first and second cable channels, each channel being alternatively accessible for accommodating one of said at least two differing cable diameters;

a channel filler block insertable into said first channel to fill said first channel preventing cable accommodation therein and rendering said second channel accessible for cable accommodation; and a strain relief plug insertably accommodated by said strain relief body, said plug being movable to a position for engaging said cable supported in either said first channel or said second channel, whereby said cable is supported in strain relief fashion between said strain relief body and said strain relief plug.

2. An electrical connector of claim 1 wherein said strain relief body includes a generally U-shaped member, said U-shaped member defining said first and second cable channels.

3. An electrical connector of claim 2 wherein said U-shaped member includes a pair of opposed side walls and a bottom wall between said side walls.

4. An electrical connector of claim 3 wherein said first channel is defined by a recess in said bottom wall of said U-shaped member.

5. An electrical connector of claim 4 wherein said recess includes raised elements for frictional engagement with said jacket of said cable supported in said first channel.

6. An electrical connector of claim 5 wherein said channel filler block is insertable into recess in said bottom wall of said U-shaped member.

7. An electrical connector of claim 6 wherein said channel filler block has a first surface insertable into said recess and an opposed second surface partially defining said second channel upon insertion of said channel filler block into said recess.

8. An electrical connector of claim 7 wherein said first surface of said channel filler block includes means engagable with said raised elements of said recess for positioning said channel filler block in said recess.

9. An electrical connector of claim 8 wherein said second surface of said channel filler block includes additional raised elements for frictional engagement with said jacket of said cable supported in said second channel.

10. An electrical connector of claim 9 wherein said channel filler block is tethered to said strain relief body by a flexible hinge.

11. An electrical connector of claim 10 wherein said channel filler block and said hinge are formed integrally with said strain relief body.

12. An electrical connector of claim 11 wherein said channel filler block is frangibly removable from said strain relief body.

13. An electrical connector for terminating a multiconductor cable comprising:

an elongate connector housing for accommodating an end extent of said cable, said connector including plural cable passage ports for permitting cable passage at plural different positions with respect to said connector housing; and a strain relief assembly for frictionally engaging and securing said cable, said strain relief assembly including:

a strain relief body movably positionable in said connector housing, said strain relief body including a cable accommodating channel positionable adjacent one of said plural cable passage ports for permitting passage of said cable through said one cable passage port, said strain relief body including port closing portions positionable adjacent said other ones of said plural cable passage ports for excluding cable passage therethrough; and a strain relief plug engagable with said strain relief body to frictionally retain said cable therebetween.

14. An electrical connector of claim 13 wherein said housing includes an upstanding side wall extending substantially around said housing, said cable passage ports being defined by U-shaped openings through said side wall.

15. An electrical connector of claim 14 wherein said port closing portions of said strain relief body are positionable adjacent said U-shaped openings.

16. An electrical connector of claim 15 wherein said port closing portions include protruding elements which are insertable into said U-shaped openings to secure said strain relief body in said housing.

17. An electrical connector of claim 14 wherein said upstanding side wall includes a back wall portion and opposed lateral wall portions.

18. An electrical connector of claim 17 wherein said back wall portion includes one U-shaped opening and each of said lateral wall portions included at least one U-shaped opening.

19. An electrical connector of claim 18 wherein said cable accommodating channel is positionable adjacent said back wall portion of said housing.

20. An electrical connector of claim 19 wherein said strain relief body includes opposed arms extending from said cable accommodating channel for closing said U-shaped openings in said lateral wall portions of said housing.

21. An electrical connector of claim 17 wherein said cable accommodating channel is positionable adjacent one of said U-shaped openings in one of said lateral wall portions.

22. An electrical connector of claim 18 wherein one said port closing portion of said strain relief body is positionable adjacent said back wall portion of said connector housing.

* * * * *